United States Patent [19]

Joubert

[11] Patent Number: 4,675,166

[45] Date of Patent: Jun. 23, 1987

[54] PROCESS FOR THE SELECTIVE SEPARATION OF URANIUM, ZIRCONIUM AND/OR HAFNIUM AND/OR MOLYBDENUM FROM A CARBONATED AQUEOUS SOLUTION CONTAINING SAME

[75] Inventor: Philippe Joubert, Lyons, France

[73] Assignee: Uranium Pechiney, France

[21] Appl. No.: 660,893

[22] Filed: Oct. 15, 1984

[30] Foreign Application Priority Data

Oct. 20, 1983 [FR] France ..... 83 17110

[51] Int. Cl.[4] ..... C01G 43/00

[52] U.S. Cl. ..... 423/11; 423/15; 423/71

[58] Field of Search ..... 423/11, 15, 17, 71

[56] References Cited

U.S. PATENT DOCUMENTS

| | | | |
|---|---|---|---|
| 3,034,856 | 5/1962 | Reusser | 423/15 |
| 3,288,570 | 11/1966 | Henrickson | 423/15 |
| 4,155,982 | 5/1979 | Hunkin et al. | 423/17 |
| 4,304,757 | 12/1981 | Kuehl et al. | 423/17 |
| 4,393,028 | 7/1983 | Crossley | 423/15 |
| 4,423,010 | 12/1983 | Maurel, I | 423/17 |
| 4,432,947 | 2/1984 | Maurel II | 423/15 |
| 4,485,075 | 11/1984 | Maurel III | 423/15 |
| 4,524,001 | 6/1985 | Joubert | 423/11 |
| 4,587,109 | 5/1986 | Lyaudet et al. | 423/15 |

*Primary Examiner*—Edward A. Miller

*Attorney, Agent, or Firm*—Jones, Day, Reavis & Pogue

[57] ABSTRACT

Process for the selective separation of uranium in carbonated aqueous solution from soluble impurities including in particular at least one of the elements zirconium and/or hafnium and/or molybdenum, thereby making it possible to produce a uraniferous liquor in a greatly improved state of purity, comprising precipitation of the zirconium and/or hafnium by introducing an alkali metal hydroxide, then separation of the zirconiferous precipitate which possibly contains hafnium and/or molybdenum from the resulting uraniferous solution with its reduced impurities content, which still possibly contains molybdenum, which is characterized in that in order to increase the removal of zirconium and/or hafnium and/or molybdenum, the uraniferous carbonated aqueous solution is treated by means of a dilute alkaline aqueous solution containing at most 17 g/l of at least one alkali metal hydroxide expressed in respect of $OH^-$, in an amount such that the resulting pH-value is imperatively higher than 11 but is generally between 11.8 and 12.5.

9 Claims, No Drawings

PROCESS FOR THE SELECTIVE SEPARATION OF URANIUM, ZIRCONIUM AND/OR HAFNIUM AND/OR MOLYBDENUM FROM A CARBONATED AQUEOUS SOLUTION CONTAINING SAME

The invention concerns a process for the selective separation of uranium in carbonated aqueous solution from soluble impurities including in particular at least one of the elements zirconium and/or hafnium and/or molybdenum.

The known processes of the prior art for treating uraniferous ores containing impurities such as zirconium and/or hafnium result in the production of impure uraniferous concentrates containing from 0.5 to 6% of zirconium with respect to the uranium. If, up to a recent time, the industries involved in treating and purifying such concentrates tolerated such a quantity of impurities, those industries are nowadays much more demanding, on the one hand because of the serious difficulties which occur in the course of the above-indicated purification treatments, and on the other hand, because of the user-specified purity requirements. In fact, as from 1981, the standard for defining the level of purity of uraniferous concentrates puts the impurities threshold in respect of zirconium at less than 0.01% by weight with respect to the uranium (standard ASTM No C 967-81).

Now, it is not possible to achieve such a low level of impurity content in regard to zirconium when using the known processes described in the literature since, as already stated above, they result in the amounts of impurities being unacceptable.

If uraniferous aqueous solutions resulting possibly from an operation of attacking an ore containing same, are subjected to one of the many forms of treatment for putting that metal into a useful form, resulting in the production of a uranate, as described in 'The Extractive Metallurgy of Uranium' by R. Merrit, 1971 edition, Colorado School of Mines Research Institute, what results is an impure uraniferous concentrate as those processes involve a single stage of precipitating the uranium by means of an alkaline agent, imparting to the treated uraniferous medium a pH-value of at least 12 and preferably higher than that value, causing the simultaneous precipitation of uranium and impurities such as zirconium and/or hafnium.

The specialist literature proposes a process for the selective separation of uranium, zirconium and molybdenum which are contained in carbonated aqueous solutions, which the man skilled in the art may think can be used for the purification treatment of uraniferous carbonated aqueous liquors containing zirconium and/or hafnium, amongst other impurities.

That process which is described in U.S. Pat. No. 3,288,570 proposes 'quantitatively precipitating the zirconium by adjusting the pH-value by means of sodium hydroxide to a value which is as close as possible to that corresponding to the beginning of precipitation of the uranium, followed by holding a temperature close to boiling point for about 1 hour'. In accordance with that process, the pH is adjusted to a value of close to 10, that is to say, to a 'pH-value which is just beyond the beginning of precipitation of the uranium by means of a 50% sodium hydroxide solution, that is to say, containing 770 g/l of that alkaline agent' (column 3, lines 58 to 75).

However, such a process suffers from disadvantages which mean that it cannot be used on an industrial scale. For, on the one hand, if the purification treatment is carried out using solutions with very high levels of concentration of NaOH (50% by weight, corresponding to 770 g of NaOH per liter of solution), after the purification treatment, there remains in the uraniferous solution an amount of zirconium such that the uranium concentrate subsequently produced does not meet the ASTM standards relating to purity, since it still contains between 2800 and 600 ppm of zirconium, with respect to the uranium, in accordance with the teaching of the above-mentioned U.S. patent (Table I and FIG. 1).

On the other hand, if an effort is made to reduce the proportion of soluble zirconium after the purification treatment by increasing the pH-value, still using the same highly concentrated NaOH solution (770 g/l), that results in untimely precipitation of the uranium, simultaneously with the zirconium, and that gives rise to a substantial loss of uranium, without nonetheless producing a useful uraniferous solution in an adequate state of purity.

Thus, the prior art proposes, to the man skilled in the art, solutions which cannot satisfy him fully since a uraniferous liquor includes zirconium and/or hafnium among the impurities present, as the proposed treatments result in the simultaneous precipitation of uranium and certain specific impurities as referred to above, subsequently necessitating a purification treatment in order to achieve the level of purity required in nuclear uses.

Since the known treatment does not meet the user requirements, the applicants, continuing their research, found and developed a process for the selective purification of uranium in carbonated aqueous solution from soluble impurities including in particular at least one of the elements zirconium and/or hafnium and/or molybdenum, thus making it possible to produce a uraniferous liquor with a highly improved degree of purity.

The process according to the invention for the selective separation of uranium in carbonated aqueous solution from the above-mentioned soluble impurities, comprising precipitation of the zirconium and/or hafnium by the introduction of an alkali metal hydroxide, then separation of the zirconiferous precipitate possibly containing hafnium and/or molybdenum from the resulting uraniferous solution with its reduced impurity content, possibly still containing molybdenum, is characterised in that, in order to increase the elimination of zirconium and/or hafnium and/or molybdenum, the uraniferous carbonated solution is treated by means of a dilute alkaline aqueous solution containing at most 17 g/l of at least one alkali metal hydroxide expressed as $OH^-$, in an amount such that the resulting pH-value is imperatively higher than 11 but generally between 11.8 and 12.5.

According to the invention, the alkaline aqueous solution used to cause the precipitation of the zirconium and/or hafnium is to contain less than 17 g per liter of $OH^-$, generally between 1 and 10 g per liter of $OH^-$ and preferably between 2 and 8 g per liter of $OH^-$.

That dilute alkaline solution makes it possible to attain the pH range of between 11.8 and 12.5 without causing untimely precipitation of the uranium, at the same time as virtually total precipitation of the zirconium and/or hafnium. For, it has been found in fact that the use of alkaline aqueous solutions at a level of concentration of higher than 17 g per liter of $OH^-$, upon adjustment of the pH-value in the above-indicated range, gave rise to abnormal precipitation of the uranium, with the zirconium and/or hafnium, without being subsequently capable of re-dissolving the co-precipitated uranium.

The dilute alkaline solution used in accordance with the process of this invention is generally prepared from alkali metal hydroxides and more particularly from hydroxides of sodium and potassium alone or in mixture. The dilute alkaline solution is desirably introduced slowly into the hot uraniferous solution to be treated according to the invention, in order for the precipitate produced to be easy to separate from its mother liquors. The pH-value of the reaction medium is measured after cooling to a temperature of from 25° C. to 30° C. and is regulated to fall in the above-indicated range, as recommended in U.S. Pat. No. 3,228,570 (column 3, lines 70 to 75).

According to the invention, the uraniferous solution to be treated is raised to a temperature of at least 40° C. in order to produce an impurities precipitate containing the zirconium and/or hafnium which can be easily separated as, below that temperature, the precipitate still occurs in the form of a gel which is very difficult to separate. The impurities precipitate is all the easier to separate from the liquid phase, as the uraniferous solution to be treated is preferably raised to a temperature selected to fall within the range of from 80° C. to boiling point.

In order to improve the conditions in regard to separation of the liquid and solid phases resulting from the treatment according to the invention, it is possible for at least a fraction of the solid separated phase containing the zirconium and/or hafnium to be recycled to the beginning of the selective separation treatment according to the invention. In that case, the amount of solid matter in suspension is desirably at least equal to 5 g/l and preferably from 100 to 200 grams per liter of suspension.

At the end of that separation operation, the solid phase with a high proportion of zirconium and/or hafnium constitutes a concentrate which can be put into useful form by means of the processes which are known to the man skilled in the art.

Likewise, at the end of the separation operation, the uranium-rich liquid phase constitutes the liquor for making the uranium into a useful product, which can be done by known means such as precipitation of an alkali metal diuranate. In the latter case, the result after separation of the uranium-containing precipitate is a dilute alkaline solution which can be used, in accordance with the process of the invention, by recycling to the operation of precipitation of the zirconium and/or hafnium for the purposes of selective separation.

Finally, it has surprisingly been found that the selective removal of zirconium and/or hafnium by precipitation by means of a dilute alkaline solution promoted the subsequent production of a uraniferous concentrate of sodium diuranate, in a substantially improved state of purity in respect of molybdenum, the latter preferentially remaining in solution upon precipitation of the uranium.

In the practice, the process according to the invention may be carried out discontinuously or continuously and, in an industrial procedure, may include the following steps:

(a) The uraniferous carbonated aqueous solution containing amongst other impurities zirconium and/or hafnium and/or molybdenum is raised to a temperature of at least 40° C.

(b) The pH-value of the hot carbonated aqueous solution is adjusted by means of a dilute alkaline aqueous solution containing at most 17 g of $OH^-$ per liter.

(b) The transfer of the suspension resulting from step (b), which is subjected to a 'separation/clarification' operation which makes it possible to collect the solid phase and the liquid phase forming the uranium production liquor.

(d) Recycling to step (a) of the solid phase resulting from step (c), containing zirconium and/or hafnium.

(e) Putting the uranium into a useful form by treatment by means of an alkali metal hydroxide of the uraniferous solution from step (c).

(f) Transfer of the suspension resulting from step (e), which is subjected to a 'separation/clarification' operation which makes it possible to collect the solid uraniferous phase and the liquid phase, which is possibly molybdeniferous, which can be subsequently put into useful form by known means.

(g) Recycling of at least a fraction of the dilute alkaline aqueous phase which is possibly molydeniferous, to step (a) of the process.

The process according to the invention can be applied to the treatment of any uraniferous carbonated aqueous solutions containing, amongst other impurities, zirconium and/or hafnium and/or molybdenum. Thus for example such a process may be integrated into the cycle for treatment of uraniferous ores, comprising both an acid attack operation followed by an extraction operation using an organic solvent and a carbonated reextraction operation, and an alkaline attack operation using an aqueous solution containing $CO_3^{--}$ and $HCO_3^-$ ions.

The invention will be better appreciated by means of the examples set out below by way of illustration.

EXAMPLE 1

This Example illustrates the solubility of zirconium and/or hafnium in a uraniferous solution in dependence on the pH-value and precipitation of said zirconium and/or hafnium by means of a dilute alkaline aqueous solution, and a comparison with the prior art.

To do this, the procedure involves using 5 liters of a uraniferous carbonated aqueous solution of the following composition, expressed in grams per liter:

U: 31.12
Zr and/or HF: 1.41
Mo: 2.16
$Na_2SO_4$: 88.00
$Na_2CO_3$: 81.80
$NaHCO_3$: 10.12

The pH-value of the uraniferous solution was 9.6.

The dilute alkaline aqueous solution was then prepared, being of the following composition in grams per liter, corresponding to the composition of a recycled dilute alkaline solution from the operation of precipitating uranium in the course of a previous test:

U: 0.010
Zr and/or Hf: 0.001
Mo: 2.200
$Na_2SO_4$: 83.800
$Na_2CO_3$: 88.300

The above-indicated dilute alkaline solution also contained sodium hydroxide expressed in terms of grams per liter of $OH^-$ which may vary according to the tests carried out, from 2.1 g/l to 68.0 g/l, while the alkaline solution used in the prior art was concentrated and contained 327.0 g/l of $OH^-$ (50% by weight solution).

Then, the uraniferous carbonated solution and the dilute alkaline solution were introduced into an agitated reactor, of suitable dimensions, with control in respect of the pH-value at 25° C. of the suspension produced by circulating an aliquot part of said suspension to a heat exchanger which is external to the reactor. Within the reactor, the resulting mixture was maintained in an agitated condition, at a temperature of 90° C.

The uraniferous solution to be treated and the alkaline treatment solution were simultaneously introduced into the most agitated region of the reactor. At the end of the operation of introducing those solutions, the suspension produced was held for 1 hour at a temperature of 90° C., with the same agitation, in the presence of an amount of dry matter in a state of suspension, from previous operations, equivalent to a concentration of the order of 30 grams per liter of suspension.

Finally, an aliquot part of the liquid phase of the suspension was taken off to carry out an analysis thereon, after the operation of separating the solid phase has been performed.

Table 1 below sets out all the particular conditions under which the experiment was performed, and the results obtained:

TABLE I

| | Concentration in $OH^-$ (expressed in g/l) of the alkaline solution used for precipitation of Zr and/or Hf | Ratio of the final volume ($V_F$ after treatment to the initial volume $V_I$ of the uraniferous solution to be treated | Final pH of the suspension measured at 25° C. | Characteristics of the uraniferous aqueous solution after selective separation of Zr and/or Hf by means of the alkaline solution | | |
|---|---|---|---|---|---|---|
| | | | | [Zr and/or Hf] soluble in mg/l | [U] soluble in mg/l | [Zr and/or Hf]/[U] in ppm |
| Prior art | 327.0 | between | 8.6 | 4563 | 36209 | 126019 |
| (reference) | 327.0 | 1.0 and 1.12 | 9.5 | 263 | 19843 | 13254 |
| U.S. Pat. No. 3,288,570 | 327.0 | | 10.0 | 53 | 18994 | 2790 |
| Invention | 2.1 | 3.08 | 10.50 | 41.0 | 10100 | 4059 |
| | 2.1 | 3.16 | 10.80 | 28.0 | 9850 | 2843 |
| | 2.1 | 3.14 | 11.30 | 17.0 | 9920 | 1714 |
| | 2.1 | 3.24 | 11.45 | 13.4 | 9600 | 1396 |
| | 2.1 | 3.15 | 11.54 | 10.8 | 9910 | 1090 |
| | 2.1 | 3.68 | 11.78 | 8.5 | 8450 | 1006 |
| | 4.3 | 2.50 | 11.90 | 7.5 | 12450 | 602 |
| | 6.4 | 2.06 | 12.00 | 7.0 | 15110 | 463 |
| | 6.4 | 2.09 | 12.20 | 6.0 | 14810 | 403 |
| | 4.3 | 2.60 | 12.50 | 4.0 | 890 | 4494 |
| | 68.0 | 1.12 | 13.50 | 1.0 | 10 | 100000 |

Thus, this Table, and in contrast to what is to be found in the prior art, indicates that there is a necessity to provide alkaline aqueous treatment solutions with a low level of concentration in respect of $OH^-$ ions in order to achieve highly improved selective separation as between uranium on the one hand and zirconium and/or hafnium on the other hand.

In addition, the pH-value at which the first precipitates of uranium appear, when the zirconium and/or hafnium are already virtually precipitated, is displaced towards the highest values, going from the order of 10 for the prior art to 12.5 for the invention.

EXAMPLE 2

This Example illustrates the influences of the initial concentration in respect of $OH^-$ ions of the alkaline aqueous solution and the pH-value after selective precipitation of the zirconium and/or hafnium on the uranium content of the precipitated and washed solid obtained after treatment by the alkaline solution.

For that purpose, this Example uses the same uraniferous carbonated aqueous solution as that used in Example 1, which was subjected to the same experimental processing using the same alkaline aqueous solutions referred to in Example 1.

At the end of the operations involved, the particular conditions in respect of the experimental procedure and the corresponding results were set out in Table II as follows:

TABLE II

| | Concentration in $OH^-$ (expressed in g/l) of the alkaline solution used for precipitation of Zr and/or Hf | Final pH-value of the suspension measured at 25° C. | Ratio by mass in percent by weight U/(Zr and/or Hf) in the washed solid |
|---|---|---|---|
| Prior art | 327.0 | 8.6 | 0.12 |
| (reference) | 327.0 | 9.5 | 0.12 |
| U.S. Pat. No. 3,288,570 | 327.0 | 10.0 | 0.50 |
| Invention | 2.1 | 11.47 | 0.49 |
| | 2.1 | 11.54 | 0.40 |
| | 2.1 | 11.78 | 0.72 |
| | 4.3 | 11.90 | 1.72 |
| | 6.4 | 12.00 | 6.53 |
| | 6.4 | 12.20 | 27.66 |
| | 17.0 | 12.20 | 442.70 |

Hence, Table II which confirms the results set out in Table I shows that it is indeed necessary to use alkaline aqueous treatment solutions with a low level of concentration in respect of $OH^-$ ions to achieve highly improved selective separation as between uranium on the one hand and zirconium and/or hafnium on the other hand, which is contrary to the suggestions in the prior art.

That establishes as fact that it is possible to operate at higher pH-values than those in the prior art, thereby to achieve improved selective separation as between uranium, zirconium and/or hafnium, while having fatal losses of uranium of the same order as magnitude as those in the prior art, whereas infinitely larger losses of uranium for those pH-values were expected.

Finally, for pH-values corresponding to values close to the upper pH-limit specified in accordance with the invention, it is found that the alkaline aqueous solution for selective precipitation is not to exceed the limit concentration of $OH^-$ of 17 g/l. Where the $OH^-$ concentration is higher than 17 g/l, the uranium losses become prohibitive.

EXAMPLE 3

This Example illustrates the attraction of recycling the zirconium and/or hafnium precipitate to the region for treating the carbonated uraniferous solution by means of the dilute alkaline aqueous solution.

In accordance with the process of the invention and in a first sequence $R_1$, 5 liters of the same uraniferous carbonated solution as that described in Example 1, the initial pH-value of which was 9.6, was raised to a temperature of 90° C. The hot uraniferous solution was then treated by means of the dilute alkaline aqueous solution with a level of concentration of $OH^-$ equal to 2.1 g/l, being introduced at about 30 minutes, until the pH-value was 11.9.

After introducing the alkaline aqueous solution, the suspension resulting from the treatment was maintained in an agitated condition at a temperature of 90° C. for a period of 60 minutes.

At the end of this first sequence, the mean diameter of the particles in suspension was measured by means of a 'COULTER' counter. The zirconiferous precipitate was then separated from the purified uraniferous solution, the separation operation being effected by filtration over a 'Fyltis' polypropylene cloth (560.6 quality 2601/BV), with a filtering area of 70 cm2.

The zirconiferous precipitate produced in the course of this first treatment sequence was introduced in a second sequence $R_2$ into 5 liters of the same uraniferous solution to be treated, the resulting suspension being subjected to the same procedure as the treatment carried out in sequence $R_1$, that is to say, at the same temperature, same pH-value and same duration.

Thus, 6 treatment sequences numbered as $R_1$ to $R_6$ were performed step by step, at the end of which measurements were systemmatically taken in respect of the mean diameter of the grains produced by way of the above-indicated apparatus, together with the specific filtration rates, on the basis of a liter of suspension.

All the results are set out in Table III below:

TABLE III

| Sequence No | Mean diameter of particles produced in microns | Particles passing at a 3 micron size expressed in percent | Particles refusing at a 15 micron size expressed in percent | Specific filtration rate in $l \cdot h^{-1} \cdot m^{-2}$ |
|---|---|---|---|---|
| $R_1$ | 3.57 | 41.7 | 3.5 | 570 |
| $R_2$ | 3.83 | 33.7 | 1.2 | 1320 |
| $R_3$ | 4.54 | 23.1 | 1.0 | 2340 |
| $R_4$ | 5.63 | 13.9 | 3.1 | 2940 |
| $R_5$ | 7.82 | 2.7 | 4.5 | 4760 |
| $R_6$ | 8.03 | 2.1 | 5.1 | 4870 |

EXAMPLE 4

This Example illustrates the beneficial influence of removing as much zirconium and/or hafnium as possible, on the subsequent production of a sodium diuranate in a highly improved state of purity in respect of molybdenum by selective precipitation by means of a dilute alkaline solution, in accordance with the invention.

For that purpose, this Example used a carbonated uraniferous aqueous solution of the following composition expressed in grams per liter:

U: 31.22
Zr and/or Hf amounts shown in Table IV
Mo: 2.16
$Na_2SO_4$: 88.00
$Na_2CO_3$: 81.81
$NaHCO_3$: 10.12

The pH-value of the uraniferous solution was 9.6.

Then, in the three tests A, B and C and for each thereof, one liter of said solution was treated by means of a 4N aqueous solution of sodium hydroxide at 90° C. for 1 hour, maintaining constant agitation. Virtually all the uranium and the zirconium present was then precipitated, in the form of alkali metal salts.

After separation and washing of the solid phase, the amount of zirconium and/or hafnium and molybdenum present in the precipitated sodium diuranate was measured.

A fourth test (Test D) involved using 1 liter of a uraniferous carbonated solution from the treatment of a uraniferous solution, the composition of which was defined in Example 1, in accordance with the process of the invention.

Virtually all the uranium and the zirconium present was precipitated from that solution (D), by precipitating them in the form of alkali metal salts by means of a 4N aqueous solution of sodium hydroxide.

After separation and washing of the solid phase, the zirconium and/or hafnium and the molybdenum present in the precipitated sodium diuranate were measured.

The particular conditions of carrying out the experimental procedure and the corresponding results are set out in Table IV below:

TABLE IV

| | Composition in g/l of the uraniferous carbonated liquor before precipitation of sodium diuranate | | | Fraction by mass in ppm with respect to uranium in the washed Na uranate precipitate | |
|---|---|---|---|---|---|
| Test reference | Zr and/or Hf in g/l | Mo in g/l | U in g/l | Zr and/or Hf / U in ppm | Mo / U in ppm |
| A | 0.791 | 2.16 | 31.22 | 25400 | 1020 |
| B | 0.440 | 2.16 | 31.22 | 13179 | 625 |
| C | 0.197 | 2.16 | 31.22 | 6300 | 268 |
| D | 0.006 | 2.20 | 20.80 | 220 | 100 |

This Table shows that removing a very substantial amount of zirconium makes it possible to avoid or limit the retention of molybdenum in the sodium diuranate, giving a degree of purity which is much better than that specified by the standard ASTM No C 967-81, that is to say, less than 1000 ppm with respect to the uranium.

I claim:

1. In a process for selectively separating uranium from soluable impurities, at least one of which is zirconium, hafnium or molybdenum, in carbonated aqueous solution, comprising the steps of adding alkali metal hydroxide to said aqueous solution to precipitate zirconium and hafnium and then separating the zirconium and hafnium precipitate from the resulting medium, the improvement wherein said alkali metal hydroxide is added in the form of a dilute alkaline aqueous solution containing at most 17 g/l, expressed in terms of $OH^-$, of said alkali metal hydroxide, and said alkaline solution is added in an amount such that the pH of the carbonated aqueous solution is between 11.8 and 12.5 measured at 25°-30° C.

2. A process according to claim 1, wherein the dilute alkaline solution contains from 1 to 10 g/l of $OH^-$.

3. A process according to claim 2, wherein the dilute alkaline solution contains from 2 to 8 g/l of $OH^-$.

4. A process according to claim 1, wherein said carbonated aqueous solution is raised to a temperature of at least 40° C.

5. A process according to claim 4 wherein the temperature is selected in the range of from 80° C. to the boiling point of said carbonated aqueous solution.

6. A process according to claim 1 wherein a fraction of the precipitate separated from the resulting medium is recycled to the carbonated aqueous solution to be purified.

7. A process according to claim 6 wherein the recycled fraction contains a quantity of solid matter of at least 5 g/l of suspension.

8. A process according to claim 7 wherein the quantity is between 100 to 200 g/l of suspension.

9. A process according to claim 1 wherein the alkali metal hydroxide is selected from the group consisting of sodium and potassium hydroxide and mixtures thereof.

* * * * *